United States Patent [19]

Hatanaka

[11] Patent Number: 4,662,410

[45] Date of Patent: May 5, 1987

[54] APPARATUS FOR FILLING ELECTRIC APPARATUSES WITH INSULATING OIL UNDER VACUUM

[75] Inventor: Shigeyuki Hatanaka, Mie, Japan

[73] Assignee: Kabushiki Kaisha Toshiba, Kawasaki, Japan

[21] Appl. No.: 872,028

[22] Filed: Jun. 9, 1986

[51] Int. Cl.[4] ..... H01F 27/00; B65B 31/02

[52] U.S. Cl. ..... 141/65; 414/217

[58] Field of Search ..... 141/7, 6.5, 169, 51, 141/59, 135, 137, 168; 336/58, 94, 219; 414/172, 196, 217

[56] References Cited

U.S. PATENT DOCUMENTS

| | | | |
|---|---|---|---|
| 2,578,024 | 12/1951 | Steinmayer et al. | 141/7 X |
| 2,707,155 | 4/1955 | Fenwick | 336/94 X |
| 3,677,423 | 7/1972 | Tollefsrud et al. | 414/196 X |
| 4,452,377 | 6/1984 | Hurley et al. | 141/7 X |

OTHER PUBLICATIONS

Transformer Drying Equipment, National Industri (Norway).

Assembly Line Transformer Remanufacturing, Dowzer.

*Primary Examiner*—Stephen Marcus
*Assistant Examiner*—Mark Thronson
*Attorney, Agent, or Firm*—Schwartz, Jeffery, Schwaab, Mack, Blumenthal & Evans

[57] ABSTRACT

An apparatus for filling electric apparatus such as transformers with insulating oil consists of first and second decompression tanks each having an opening at one side for taking the transformers in and out of each tank. The tanks are placed so that the openings are opposed to each other. A flatcar is provided between the openings of the tanks and reciprocally moved in the direction in which the openings of the tanks are opposed to each other. A door is provided on the flatcar. The openings of the tanks are alternately closed by the door when the flatcar is reciprocally moved. Two carriers for carrying the transformers are provided on respective sides of the door. The transformers carried on the carriers are alternately taken in and out of the tanks when the flatcar is reciprocally moved. The apparatus further includes a vacuum pump for decompressing each tank. The transformers are filled with insulating oil in the tanks under decompressed condition.

9 Claims, 11 Drawing Figures

APPARATUS FOR FILLING ELECTRIC APPARATUSES WITH INSULATING OIL UNDER VACUUM

BACKGROUND OF THE INVENTION

1. FIELD OF THE INVENTION

This invention relates to an apparatus for filling the outer case enclosing a transformer or condenser assembly or the like with insulating oil under the decompressed condition so that an oil-filled electric apparatus may be obtained, and more particularly to such an apparatus comprising two decompression tanks each having an opening for taking a work as the electric apparatus to be filled with insulating oil in an out of the tank, the openings being closed and opened by a door.

2. DESCRIPTION OF THE PRIOR ART

In order to obtain the oil-filled electric apparatus such as an oil-filled transformer, when the outer case enclosing the transformer assembly is usually taken in the decompression tank. The transformer assembly is devaporized and dehumidified by decompressing the tank. The outer case of the transformer is filled with oil under the decompressed condition. In the case of small and middle sized transformers, the transformers fed through an assembly line are successively taken in the decompression tank. When a plurality of transformers are placed in the large-sized tank, the tank is decompressed and the outer cases of the transformers are filled with insulating oil. In the above-described batch processing, it takes much time to gather a plurality of transformers in the tank. Furthermore, the decompressing operation also takes much time because of the large-sized decompression tank. In addition, since the transformers are filled with oil one by one, an operator at the next station of the assembly line must be on the standby alert for the transformers to by conveyed for a long time.

SUMMARY OF THE INVENTION

It is, therefore, a primary object of this invention to provide an improved apparatus for filling the electric apparatuses with insulating oil under vacuum wherein one or plurality of works can successively be put into the decompressing operation and filled with oil.

It is another object of this invention to provide an improved apparatus for filling the electric apparatuses with insulating oil under vacuum wherein the working for preparing to convey a work already filled with oil to a next station can be performed in parallel with the working for preparing to fill a following work with oil so that the working efficiency may be improved.

According to this invention, the apparatus for filling the electric apparatuses with insulating oil under vacuum comprises first and second decompression tanks in each of which the works as the electric apparatuses are placed. Each tank has an opening at one side thereof in its entirety. The works are taken in and out of the tanks through the openings. The decompression tanks are disposed so that the openings are opposed to each other with a predetermined space therebetween. A door is provided between the openings. The door is reciprocally moved by a drive means in the direction in which the openings are opposed to each other, thereby closing and opening the openings alternately. Two carriers are provided at both sides of the door respectively. When the door is moved to the first decompression tank, the carrier at the side thereof is allowed to go into the tank, while the carrier at the other side is allowed to go out of the second decompression tank. The works are thus taken in and out of respective tanks alternately by the carriers and simultaneously the decompression tanks are alternately closed and opened by the door. The works are devaporized and filled with oil in the decompression tank alternately closed air-tightly by the door.

According to the above-described construction, one or plurality of works are taken in each decompression tank, so that each tank has a smaller capacity than the tank of prior art apparatus. Consequently, the space to install the apparatus is decreased as compared with the prior art apparatus and the length of time for the decompressing operation is shortened. Furthermore, when one or plurality of works are taken in the one decompression tank, both workings to decompress the tank and to fill the work or works with insulating oil are succesively performed. In addition, while one tank is being decompressed or while the works are being filled with oil in one tank, preparation to fill the works in the other tank with oil or the working to carry the works filled with oil to a next station of the assembly line can simultaneously be performed.

Other and further objects of the invention will become obvious upon an understanding of the illustrative embodiment about to be described or will be indicated in the appended claims, and various advantages not referred to herein will occur to one skilled in the art upon employment of the invention in practice.

DESCRIPTION OF A PREFERRED EMBODIMENT

Figure 6:
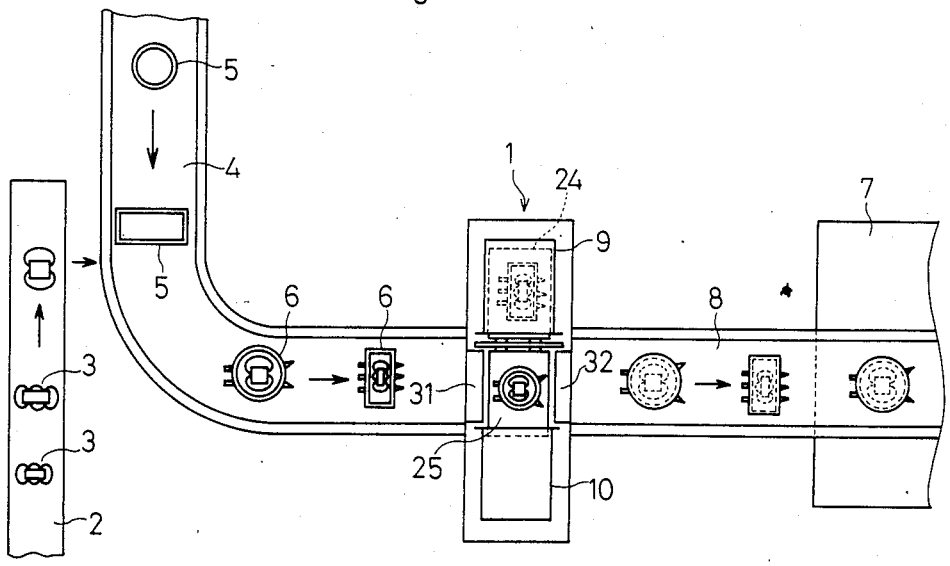
FIG. 6 is a plan view of the assembly line in which the apparatus in accordance with this invention is incorporated.

A preferred embodiment of this invention will now be described with reference to the drawings. As shown in FIG. 6, the apparatus for filling electric apparatuses with insulating oil under vacuum in accordance with this invention is incorporated in the assembly line for producing oil-filled transformers. Referring to FIG. 6, numeral 2 designates a conveyor system which conveys transformer assemblies 3 each comprising two coils and a core. The transformer assembly 3 is to be enclosed in an outer case 5 conveyed by a roller conveyor 4 to thereby make up a transformer 6. The transformer 6 is further conveyed to the apparatus 1. After being filled with oil under the decompressed condition, the transformers 6 is conveyed to a next station 7 such as a test station by a roller conveyor 8.

Figure 1:
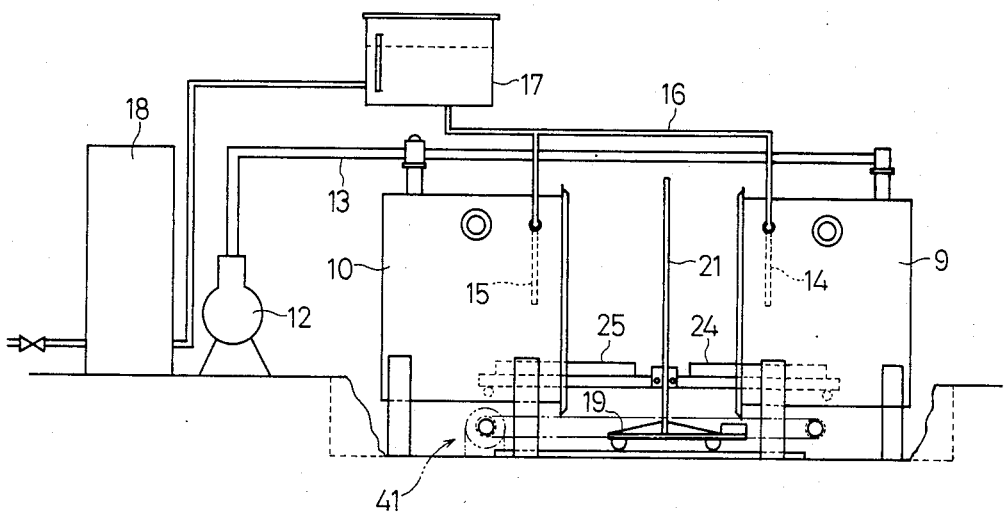
FIG. 1 is a side view of the apparatus for filling the electric apparatus with insulating oil under vacuum in accordance with this invention which is combined with a decompressing means and a means for supplying oil.
Figure 2:
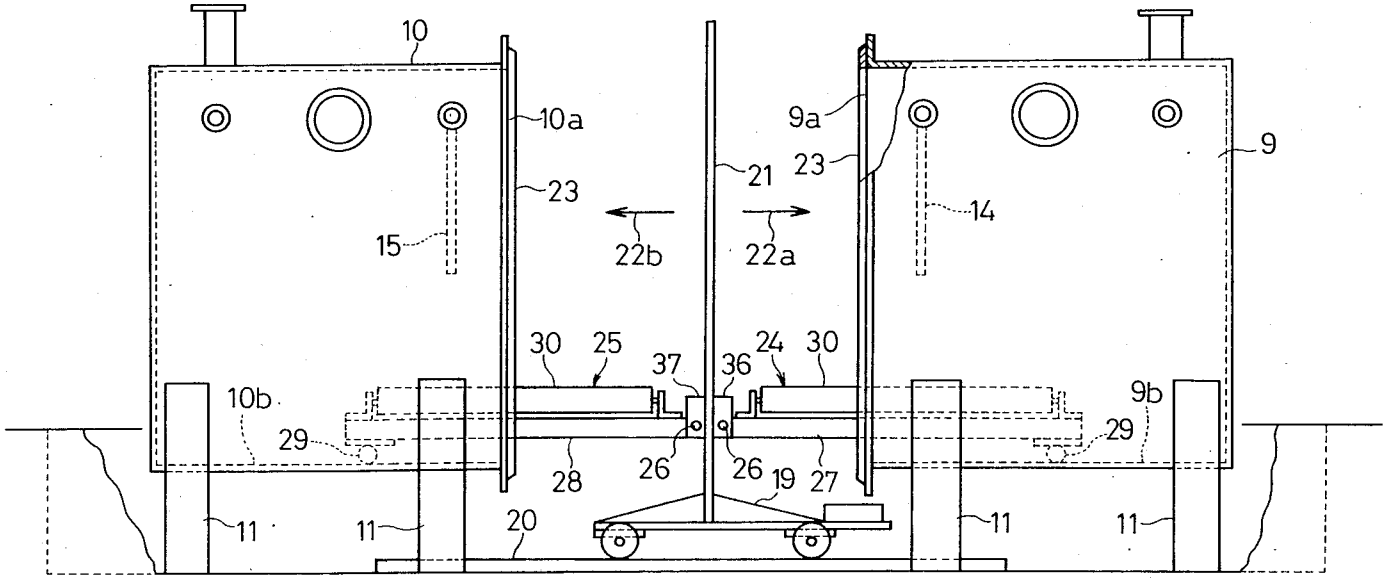
FIG. 2 is an enlarged side view of the apparatus in accordance with this invention, in which view the decompressing means and oil-supplying means are removed.

The apparatus 1 will now be described in detail. Referring to FIGS. 1 and 2, first and second decompression tanks 9 and 10 have openings 9*a* and 10*a* respectively at one side thereof in its entirety. The works are taken in and out of the tanks 9 and 10 through respective openings 9*a* and 10*a*. The decompression tanks 9 and 10 are mounted on supports 11 so that the openings 9*a* and 10*a* are opposed to and spaced from each other. A vacuum pump 12 is connected to the tanks 9 and 10 through a pipe 13. Operation to decompress respective tanks 9 and 10 are independently performed by a control valve not shown. The decompression tanks 9 and 10 are provided with respective hoses 14 and 15 making up a means for supplying the works with oil. The hoses 14 and 15 are connected to an oil storage tank 17 through a pipe 16. The oil storage tank 17 is adapted to be supplied with oil through a devaporizing means 18 from an oil supply source not shown. Supplying respective hoses 14 and 15 with oil is independently performed by a control valve not shown. As shown in FIGS. 2–5, a flatcar 19 is provided between the openings 9*a* and 10*a* of the tanks 9 and 10. The flatcar 19 is reciprocally movable on rails 20 between the tanks 9 and 10. The flatcar 19 is provided with a door 21 of the plate shape which is standing thereon. The door 21 has larger dimensions than the openings 9*a* and 10*a*. When the flatcar 19 is moved in the direction of arrow 22*a* by a predetermined distance, the door 21 abuts against the first decompression tank 9 to thereby close the opening 9*a* air-tightly. When the flatcar 19 is moved in the direction of arrow 22*b* by a predetermined distance, the door 21 abuts against the second decompression tank 10 to thereby close the opening 10*a* air-tightly. Suitable packing members 23 are applied on respective peripheral edges of the openings 9*a* and 10*a* to provide sealing. First and second carriers 24 and 25 are disposed on respective sides of the door 2 so that the works 6 may be taken in and out of respective tanks 9 and 10. Each of the carriers 24 and 25 has respective carriages 27 and 28. One end of each of the carriages 27 and 28 is connected to respective sides of the door 21 by a pin connecting mechanism 26 which will be described in detail hereafter. The other end of each of the carriages 27 and 28 is carried on casters 29 which are movable on respective bottom plates 9*b* and 10*b* inside the tanks 9 and 10, whereby the carriages 27 and 28 are alternately allowed to go into and out of respective tanks 9 and 10 when the flatcar 19 having the door 21 is reciprocally moved. Each of the carriages 27 and 28 is provided with a plurality of rollers 30 as rotatable members which are pivotally mounted for rotatable movement in the direction in which the openings 9*a* and 10*a* are opposed to each other. Each of the carriers 24 and 25 each including a plurality of rollers 30 has the same height as both of the roller conveyors 4 and 8.

Figure 3:
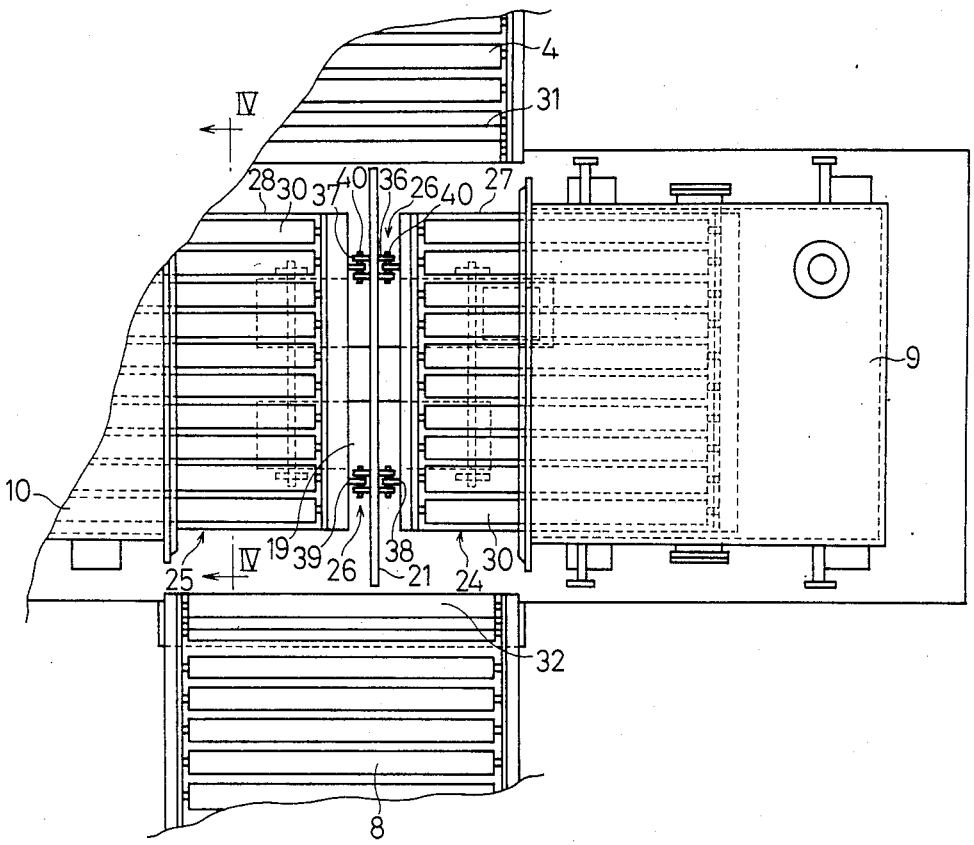
FIG. 3 is a partially exploded plan view of the apparatus in accordance with this invention.
Figure 4:
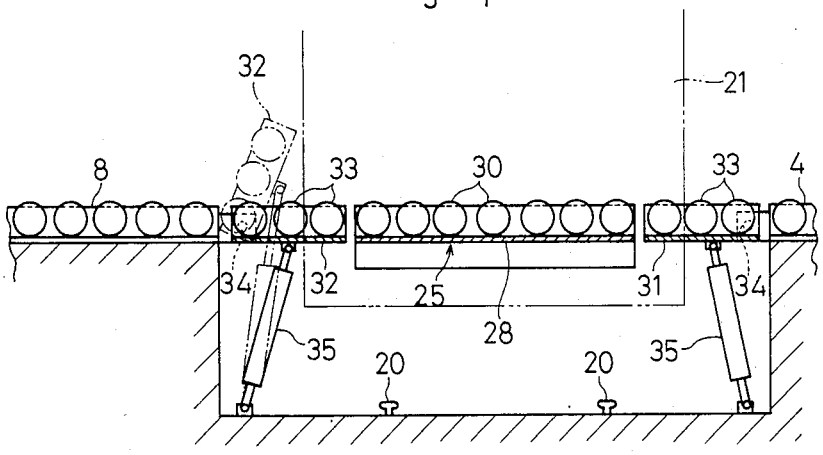
FIG. 4 is a schematic longitudinal sectional view taken along the line IV—IV in FIG. 3.

In order that the works 6 on the roller conveyor 4 may be carried to each of the carriers 24 and 25 and further that the works 6 may be carried from the apparatus 1 to the roller conveyor 8, a movable member 31 is provided between the roller conveyor 4 and one of the spaces in which the carriers 24 and 25 are moved, and a movable member 32 is provided between the roller conveyor 8 and the other space in which the carriers 24 and 25 are moved as shown in FIGS. 3 and 4. Each of the movable members 31 and 32 has a plurality of rollers 33 on the upper side thereof, so that the works 6 can easily be carried. One end of each of the movable members 31 and 32 is connected to respective roller conveyors 4 and 8 for rotatable movement about respective shafts 34. Each of the movable members 31 and 32 has an air cylinder 35 by which respective movable members 31 and 32 moved upwardly about respective shafts 34, so that the movable members 31 and 32 are changed from the horizontal state to a nonhorizontal state, for example, the vertical state. When respective movable members 31 and 32 are in the vertical state, they are prevented from coming into collision with the door 21 which is reciprocally moved with the flatcar 19.

Figure 5:
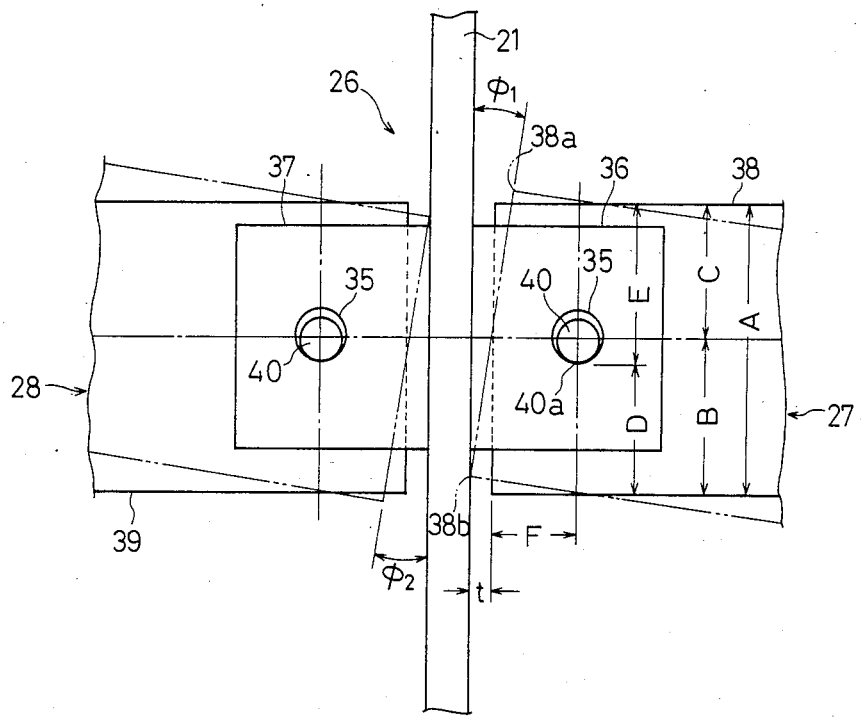
FIG. 5 is an enlarged side view of a pin connecting mechanism employed in the apparatus in accordance with this invention.

The above-mentioned pin connecting mechanism 26 wil be described with reference to FIG. 5. Forked support members 36 and 37 are welded on respective sides of the door 21. Each of the support members 36 and 37 has an opening 35. Pins 40 are secured on respective connecting projections 38 and 39 secured to the distal end of respective carriages 27 and 28. The diameter of each opening 35 is larger than that of each pin 40, which is loosely received by the openings 35 respectively.

This embodiment employs an electric motor driven chain mechanism 41 as a means for moving the flatcar 19, as schematically shown in FIG. 1.

Figure 7:
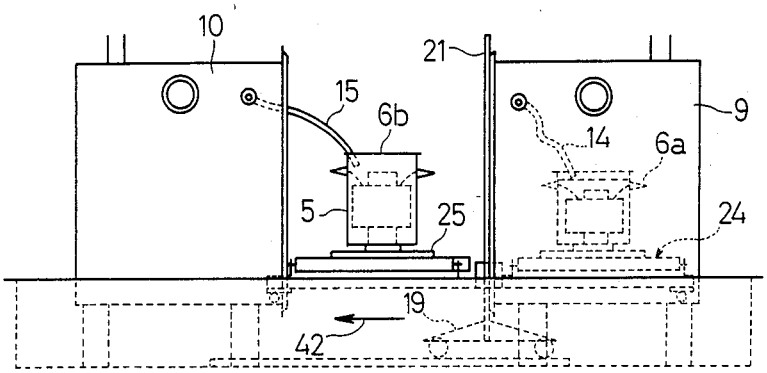
FIGS. 7 through 10 are schematic side views of the apparatus in accordance with this invention in different operations.
Figure 8:
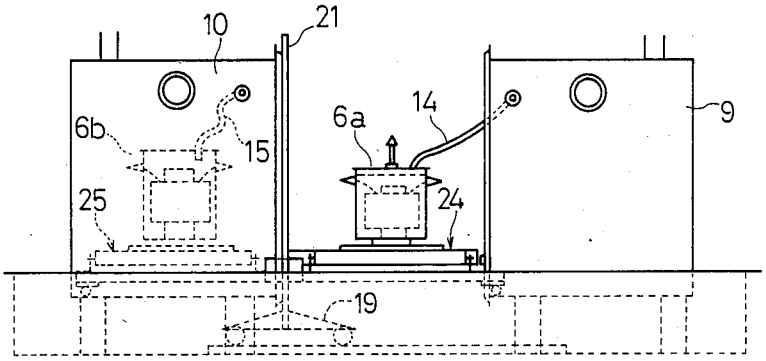
Figure 9:
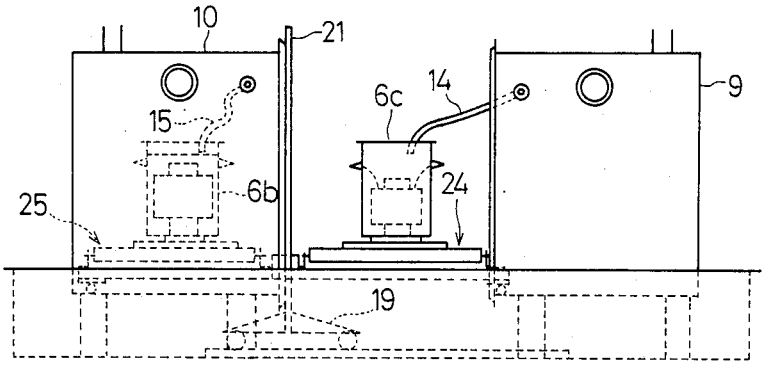
Figure 10:
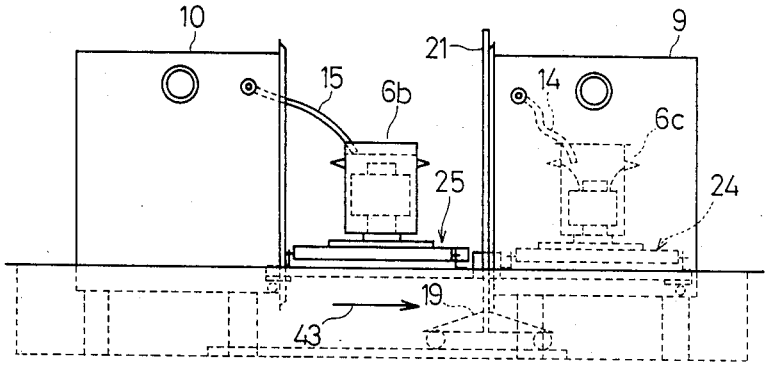

Operation of the apparatus of this invention will be described with reference to FIGS. 7 through 10. FIG. 7 shows that a preceding work 6*a* is being filled with oil under the decompressed condition in the tank 9. Furthermore, the following work 6*b* is placed on the second carrier 25 with the hose 15 put into the outer case 15 thereof. In the condition shown in FIG. 7, when the work 6*a* is completely filled with oil, the flatcar 19 is moved in the direction of arrow 42. Movement of the flatcar 19 moves the second carrier 25 carrying the work 6*b* into the second tank 10, as shown in FIG. 8. Simultaneously, the first carrier 24 carrying the work 6*a* is moved out of the tank 9 and the door 21 closes the opening 10*a* of the tank 10. The tank 10 enclosing the work 6*b* is decompressed and the operation to fill the work 6*b* with oil is started. In this while, the hose 14 is removed from the work 6*a*. The work 6*a* is then carried along a plurality of rollers 30 of the first carrier 24 and sent onto the roller conveyor 8 through the movable member 32. Furthermore, a new work 6*c* is carried from the roller conveyor 4 to the first carrier 24 and the hose 14 is inserted into the work 6*c*. When the work 6*b* is completely filled with oil, the flatcar 19 is moved in the direction of arrow 43 shown in FIG. 10. Consequently, the door 21 is moved with the flatcar 19, so that the second tank 10 is opened and the work 6*c* is taken out of the second tank 10. The work 6*c* is taken into the first tank 10. The opening 9*a* is then closed by the door 21 simultaneously. The above-described operation is repeated afterwards.

According to the apparatus of this invention, while one work is being filled with oil in one decompression tank, a preceding work which is already filled with oil in the other work is carried to the next station, or the preparatory working for the following work which is to be filled with oil in the other tank is done simuultaneously. Consequently, the operation for decompressing the tank and the operation for filling the work with oil can successfully be performed. Furthermore, the capacity of each decompression tank is small as compared with that of the prior art batch processing type apparatus, so that the operation for filling the work with that of the prior art batch processing type apparatus, so that the operation to decompress the tank is completed in shorter length of time. As a result, the length of time in which the operator is on the standby alert is shortened, which brings about the improvements of the operation efficiency.

Where the openings 9*a* and 10*a* are alternately closed air-tightly by the door 21 which is moved with the flatcar 19, a gap is made between the door 21 and respective openings 9*a* and 10*a* if the door 21 is not completely perpendicular to the flatcar 19. This causes each of the tanks 9 and 10 to be incompletely closed. It is easy to rigidly secure the door 21 to the flatcar 19 by means of welding and the like so that the door 21 may be completely perpendicular to the flatcar 19. However, when the door 21 is rigidly seured to the flatcar 19, it tends to incompletely abut against respective tanks 9 and 10 due to the variations in degree of horizontality of the rails 20 or unparallelism between the rails 20 and respective inside bottom surfaces 9*b* and 10*b* of the tanks 9 and 10. To prevent such a case, the members need to be held to precise tolerances in dimensions.

In these circumstances, the pin connecting mechanism 26 is employed in this embodiment. The pin connecting mechanism 26 renders it possible to air-tightly close respective openings 9*a* and 10*a* without requiring the members to be held to precise tolerances. Following description refers only to the carrier 24 for brevity. As shown in FIG. 5, the external diameter of the pin 40 secured to the projection 38 on the side of the carrier 24 is smaller than the inner diameter of the opening 35 formed in the support member 36 fixed on the door 21, so that the door 21 is allowed to be inclined slightly right and left as shown by angles $\phi 1$ and $\phi 2$ in FIG. 5. Consequently, the door 21 comes into air-tight engagement with respective openings 9*a* and 10*a* of the tanks 9 and 10 by just moving with the flatcar 19 without making any gap therebetween. In case the angles $\phi 1$ and $\phi 2$ of the door 21 are excessively increased, the deviation of the center of gravity of the door 21 decreases movability of the flatcar 19, thereby increasing danger. However, in this embodiment, the abutment of the door 21 against the upper and lower corner portions 38*a* and 38*b* stops the inclination of the door 21. In FIG. 5, reference symbol A denotes the thickness of the projection 38. Dimensions shown by symbols B and C are gained by dividing the thickness A into two parts at the center of the opening 35. Dimensions D and E are gained by dividing the thickness A into two parts at a contact point 40*a* where the pin 40 abuts against the opening 35. Reference symbol F denotes the dimension from the contact point 40*a* to the distal end of the projection 38. Reference symbol t denotes the gap between the door and the projection 38. The angles $\phi 1$ and $\phi 2$ are limited within a range of suitable values by selecting the dimensions D, E and F and the value of the gap t. The approximate value of the angle $\phi 1$ is gained by the following expression:

$$[\mathrm{Sin}^{-1}(t+F)\times(F^2+D^2)^{\frac{1}{2}}]-(\tan^{-1} F/D)$$

The pin connecting mechanism 26 renders it easy to attain the value denoted by the above-mentioned expression.

Furthermore, the openings 9*a* and 10*a* are opposed to each other across the roller conveyors 4 and 8 of the assembly line. The height of the carriers 24 and 25 is approximately the same as that of the roller conveyors 4 and 8. Consequently, the works can easily be carried between the assembly line and the apparatus of this invention.

A plurality of rollers 30 renders it easy to carry the works between the assembly line and the carriers 24 and 25. Furthermore, the rollers 30 pivotaly mounted for rotation in the direction perpendicular to the direction in which the openings 9*a* and 10*a* are opposed to each other prevent the works from being excessively moved toward the inside wall of respective tanks 9 and 10 by the inertia and colliding with the wall.

Although the flatcar is employed as a means for supporting and moving the door 21 in the embodiment, the door 21 may be hung on a movable member mounted on the ceiling of the factory.

It is desirable that clamping means be provided between the door 21 and respective openings 9*a* and 10*a* of the tanks 9 and 10 so that the air-tightness therebetween is further effected.

Figure 11:
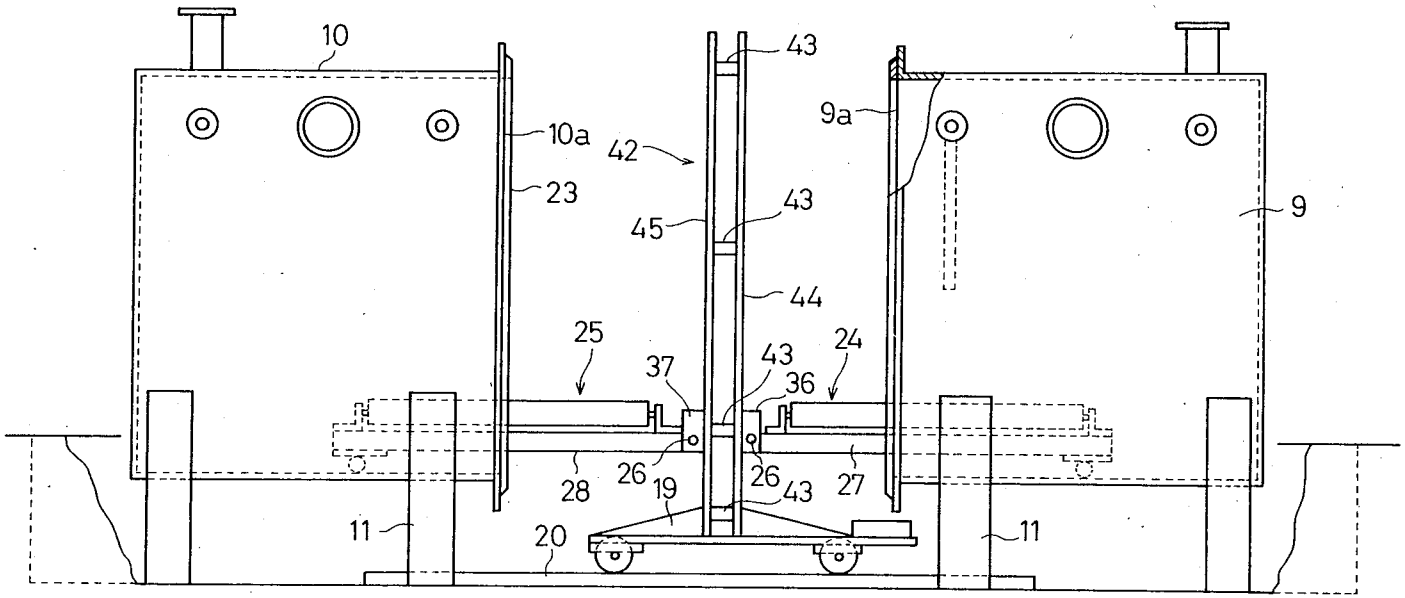
FIG. 11 is a view similar to FIG. 2 showing a modified form of the apparatus in accordance with this invention.

FIG. 11 shows a modified form of the above-described embodiment. Same parts are labelled by the same numerals as in FIG. 2. In the modification, a door 44 comprises two door plates 46 and 47 which are opposed to each other with a plurality of connecting spacers 45 provided therebetween. The opening 9*a* of the first decompression tank 9 is closed and opened by the door plate 46. The opening 10*a* of the second decompression tank 10 is closed and opened by the other door plate 47.

What is claimed is:

1. An apparatus for filling electric apparatuses with insulating oil under vacuum, comprising:

a. first and second decompression tanks each having an opening at one side thereof in its entirety for taking works in and out of each tank, each said tank being disposed so that said openings are opposed to and spaced from each other and each being provided with a means for decompressing the inside thereof below a atmosphere and a means for filling the works with insulating oil;

b. a door mounted on a suitable movable means for movement between said openings of said decompression tanks so as to alternately close and open said openings of said decompression tanks, whereby said door closes said opening of said first decompression tank when moved in one direction and closes said opening of said second decompression tank when moved in the opposite direction; and c. two carriers coupled to respective sides of said door so as to be reciprocally moved with said door for alternately taking the works in and out of said first and second decompression tanks through respective said openings.

2. An apparatus for filling electric apparatuses with insulating oil under vacuum, as set forth in claim 1, wherein including an assembly line for the works, and said first and second decompression tanks are disposed so that said openings thereof are opposed to each other across the conveying way of said assembly line for the works.

3. An apparatus for filling electric apparatuses with insulating oil under vacuum, as set forth in claim 1, wherein each said carrier is provided with a plurality of rolling members pivotally mounted for movement in the direction perpendicular to the direction in which said openings of said decompression tanks are opposed to each other, thereby transferring the works.

4. An apparatus for filling electric apparatuses with insulating oil under vacuum, as set forth in claim 1, wherein said movable means is a flatcar which is moved between said openings of said decompression tanks and on which said door is provided.

5. An apparatus for filling electric apparatuses with insulating oil under vacuum, as set forth in claim 1, wherein said door is comprised of two door plates moved with each other, one of said door plates being adapted to close and open said opening of one of said decompression tanks, the other door plate being adapted to close and open said opening of the other decompression tank.

6. An apparatus for filling electric apparatuses with insulating oil under vacuum, as set forth in claim 1, wherein each said carrier is connected to said door at one end thereof by a connecting mechanism comprising an opening and a pin member loosely received by said opening, the other end of said each carrier being movably mounted on each decompression tank.

7. An apparatus for filling electric apparatuses with insulating oil under vacuum, as set forth in claim 1, wherein said works are oil-filled transformers.

8. An apparatus for filling electric apparatuses with insulating oil under vacuum, as set forth in claim 2, wherein the height of said each carrier is approximately the same as that of the conveying way of the assembly line.

9. An apparatus for filling electric apparatuses with insulating oil under vacuum, as set forth in claim 8, which further comprises two movable members each provided between the conveying way of the assembly line and the respective spaces in which said carriers are moved, each said movable member being changeable between the horizontal state and a non-horizontal state, each said movable member further allowing the works to be conveyed through the upper surface thereof when in the horizontal state and preventing the collision with said door moving when in the non-horizontal state.

* * * * *